United States Patent [19]

Lemelson

[11] 4,337,462

[45] Jun. 29, 1982

[54] THEFT DETECTION SYSTEM AND METHOD

[76] Inventor: Jerome H. Lemelson, 85 Rector St., Metuchen, N.J. 08840

[21] Appl. No.: 202,885

[22] Filed: Nov. 3, 1980

Related U.S. Application Data

[63] Continuation-in-part of Ser. No. 858,669, Dec. 27, 1977.

[51] Int. Cl.[3] ..... G08B 13/14

[52] U.S. Cl. ..... 340/572; 340/65; 340/539; 340/568

[58] Field of Search ..... 340/65, 528, 539, 541, 340/568, 571, 572

[56] References Cited

U.S. PATENT DOCUMENTS 4,177,466 12/1979 Reagan ..... 340/63

4,257,038 3/1981 Rounds et al. ..... 340/63

*Primary Examiner*—Alvin H. Waring

[57] ABSTRACT

A theft detection system and method for detecting the unauthorized movement of an article or assembly from a given location, such as in the act of theft or burglarizing a home, office, store or warehouse. Detection of such unauthorized movement or theft may be made at a remote location, such as a monitor station particularly when such movement is detected beyond predetermined bounds or limits. The system involves the short wave transmission of code signals which are indicative of the identity of the article or assembly and/or the location of its unauthorized movement.

13 Claims, 3 Drawing Figures

THEFT DETECTION SYSTEM AND METHOD

RELATED APPLICATIONS

This is a continuation-in-part of Ser. No. 858,669 filed Dec. 27, 1977 for Electronic Detection System.

SUMMARY OF THE INVENTION

This invention relates to a system and method for detecting unauthorized movement or theft of articles and assemblies, such as valuable possessions of a home owner, stock or display articles in a store, articles or containers in a warehouse; furniture, accessories or machinery associated with an office, manufacturing or maintenance facility. In particular, the system employs microminiature electronic circuitry which may be supported by or hidden within an article of value such as a work of art, living or room accessory, furniture, manufacturing or maintenance equipment, which electronic circuit becomes activated and generates a short wave code when a predetermined movement or change in the location of the article or assembly is effected. Such short wave code is transmitted either directly to a monitor station or to an electronic transponder which retransmits the code to a monitor station at which monitor station means are provided for indicating the movement of the article, its location and identification and, in certain instances, the route along which it is being moved or its instant location during such movement.

In conventional anti-theft systems, an alarm is generally generated upon illegal entry to a room or other location containing valuables which may be removed therefrom. If such illegal entry is not detected, theft or burglary may be effected of valuable possessions without difficulty.

By effecting protection for individual articles, assemblies and machinery by means of microminiature electronic code generating and short wave transmitting devices which may be hidden from view, the instant invention provides a more positive means for protecting valuable possessions, furniture and equipment from theft.

Accordingly it is a primary object of this invention to provide a new and improved system and method for protecting articles, machinery, valuable art work, furniture and other equipment from theft.

Another object is to provide an anti-theft system and method for protecting articles from theft, which system is easy to install and does not require expensive wiring.

Another object is to provide a system and method for protecting against the theft of valuables, which system may be quickly installed and applied without difficulty.

Another object is to provide an anti-theft system which does not require much maintenance.

Another object is to provide an anti-theft system which is easily applicable for protecting individual articles, furniture and valuables located within a compound or room.

Another object is to provide an anti-theft system which may be easily employed to protect strong boxes, safes, drawers and the like against theft.

With the above and such other objects in view as may hereinafter more fully appear, the invention consists of the novel constructions, combinations, arrangements of parts and method as will be more fully described and illustrated in the accompanying drawings, but it is to be understood that variations, changes and modifications may be restored to which fall within the scope of the invention as claimed.

BRIEF DESCRIPTION OF THE DRAWINGS

In the drawings:

In FIG. 1 is shown an article or assembly 11 to be protected against theft, which assembly is specifically illustrated as a piano although it may be any other article or assembly of manufacture including a valuable piece of furniture, office equipment, machine, fixture or work of art. An upper housing 12 is supported by a plurality of legs 13, one of which contains the transmitting antenna 14 extending therethrough or therealong from an electronic assembly 15 supported within one leg. The electronic assembly and antenna may also be supported within the main body or housing 12 of the piano and is preferably hidden from view. In FIG. 2, an electronic system 10 is shown in detail and may be powered by a battery [not shown] or other form of electrical energy generator connected to the circuit components illustrated. The system 10 includes an X-direction accelerometer 16, a Y-direction accelerometer 17 and a Z-direction accelerometer 18, each of which accelerometers are connected to respective electronic analog-to-digital converters 19, 20 and 21.

Figure 1:
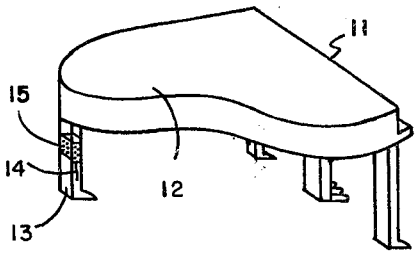
FIG. 1 is an isometric view of an article of manufacture, such as a piano, containing an anti-theft device hidden in the leg thereof.

A vibration sensor 22 is also provided to generate output signals when vibrations are detected thereby which signals are digitized by passing same to an attendant analog-to-digital converter 23. Each of the analog-to-digital converters 19, 20, 21 and 23 have respective inputs to a microminiature electronic computer 24 which may comprise an integrated circuit electronic microprocessor adapted to process and effect computations with respect to the signals received thereby. The microprocessor 24 thus detects accelerations in all directions of movement and computes velocities and total distances moved in accordance with the signals output by the accelerometers, which information is stored in a memory 25 which may be a separate microminiature electronic circuit or one formed on the same substrate or chip containing the microprocessor 24.

If the total accumulative movement exceeds a preprogrammed value, a condition which may indicate that the object or assembly being guarded has been moved more than an allowable or predetermined amount, such as in the act of cleaning the article or the room and during a predetermined time period, as determined by a time-based signal generator 26, microprocessor 24 interprets such condition as an unauthorized movement and activates an identification code generating circuit 27, the code signal output of which is passed to a short wave transmitter 28 which receives signals from a driver 29 controlled by an output of the computer or microprocessor 24. As a result of such signal activation, the transmitter 28 transmits or radiates the code or codes received thereby from the code generator 27, on its antenna 14 for short wave transmission to a short wave receiver of the type provided in FIG. 3.

Figure 2:
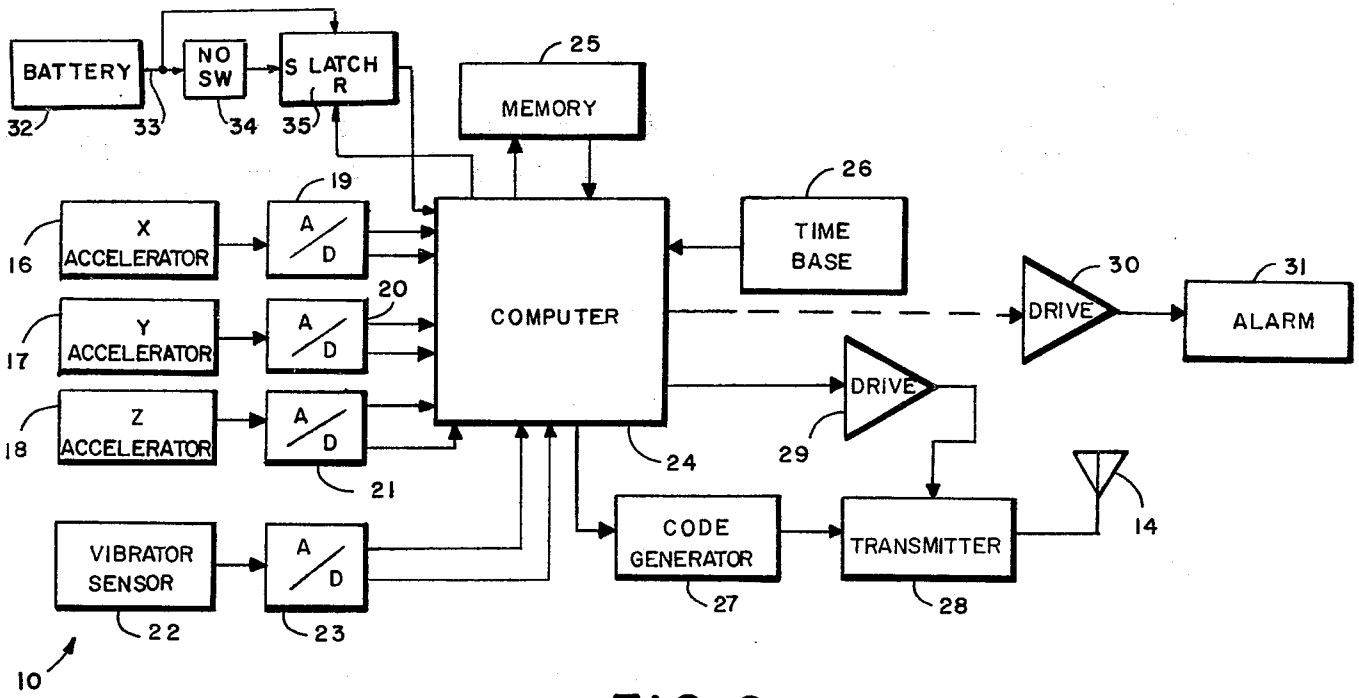
FIG. 2 is a schematic diagram of the electronic system employed at or within the article or assembly being protected against theft.

Also illustrated in FIG. 2 is a local alarm 31 which is activated by a driver 30 receiving a signal from the computer or microcomputer 24. Alarm 31 may generate a loud sound within or adjacent the article or piano for locally indicating an illegal degree of movement of the article protected thereby and warning anyone who may be within range that such illegal movement is being effected.

Figure 3:
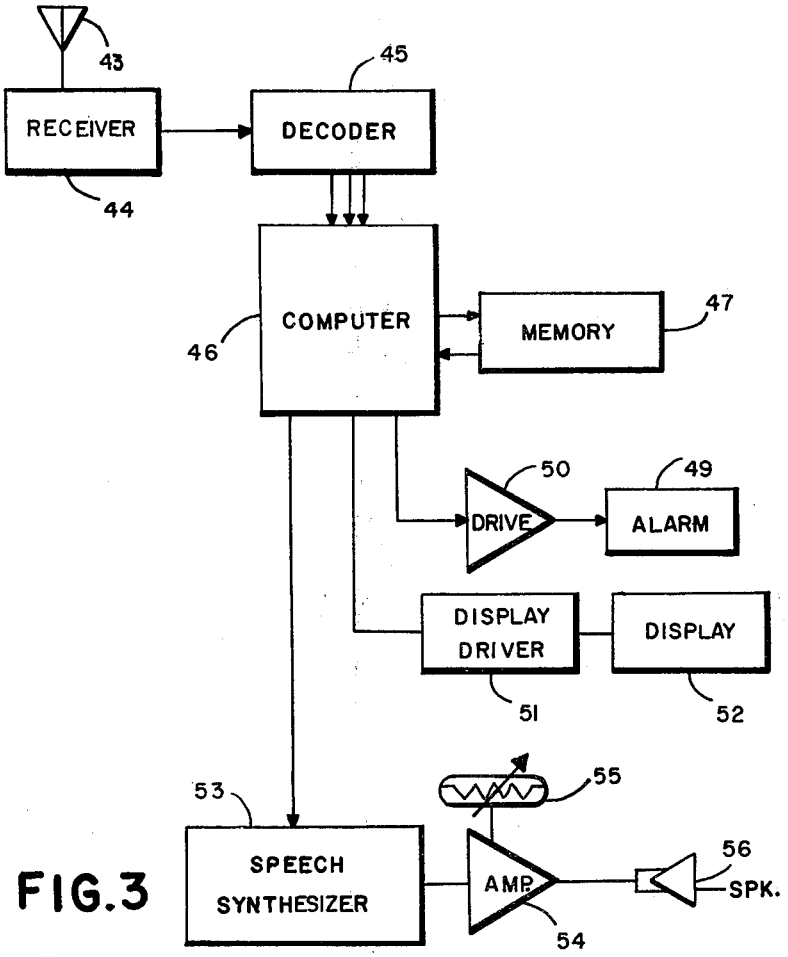
FIG. 3 is a schematic diagram of the electronic system employed at a remote location for detecting the unauthorized movement or theft of the article or assembly containing the electronic circuit of FIG. 2.

In FIG. 3 is shown a remote receiver for the signals generated on the output of the transmitter 28 of FIG. 2. A power supply such as a source of line current, transformer or battery, supplies electrical energy to the circuit elements of FIG. 3 when its control switch is closed, thereby energizing the short wave receiver 44, a decoder 45, a computer or microprocessor 46, an alarm 49, display 52 and speech synthesizing circuit 53 together with their attendant drive and amplifying circuits.

Code signals transmitted by short wave transmitter 28 are intersected by an antenna 43 for receiver 44 and are generated as corresponding code signals on the output of receiver 44 which extends to a decoder 45 which is connected to computer or electronic microprocessor 46. Such received code may be passed from the computer 46 to a memory 47 for its repeated acquisition to effect or control the operation of one or more alarm and indicating devices. When a code signal is received from one of a number of locations or articles at a given location, computer or microprocessor 46 activates an alarm 49 by suitably energizing a driver 50.

The computer 46, after processing the signals input thereto, generates control signals which are passed to a display driver 51 which energizes and controls the operation of a suitable visual display 52, such as a cathode ray tube, array of LED alphanumerical display elements or other means operable to display and indicate the location of an attempted theft or thefts.

If it is desired to vocally indicate the location of the article or assembly which has been moved an unauthorized degree from its location, signals generated on the output of the computer or microprocessor 46 are also passed to a speech synthesizing circuit 53 and speech signals, such as synthetic speech signals, generated thereby are passed to an amplifier 54, having an attendant volume control 55, and connected to a speaker 56 for generating sounds of words indicative of such variables as the article or assembly 11 which is in motion or moved beyond a given point and/or its location.

The speech synthesizor circuit 53 may comprise one of a number of such microminiature electronic circuits which are available, such as the Texas Instruments TMC-0280, which may contain its own digital-to-analog conversion circuit or may be connected to such a circuit for providing analog signals of speech indicative of the articles being protected and its location, for use by the speaker 56 in vocally indicating such attempted theft.

The vibration sensor 22 of FIG. 2 may be operable to provide signals on its output related, for example, to noises associated with movement of the article or piano from an at-rest location and such information may be used by the computer to determine if the piano is being tampered with, disassembled or moved in an unauthorized manner so as to indicate an attempted theft thereat.

In the event that the monitor station is located out of range of the code signals which are short wave transmitted by antenna 14 attached to the article of assembly being protected, an intermediate receiver and transmitter or transponder may be provided, for example, a short distance away from the article or articles being protected, such as in a conventional radio or television set wherein the antenna thereof may be utilized to properly transmit such code or codes either directly to the monitor station receiver or to another relay or transponder station for transmission to such monitor station.

In certain theft detection applications, it may suffice to employ a single accelerometer with or without a single vibration sensor to locally and/or remotely detect theft or unauthorized movement of an object from an at rest or diaply location. In other applications, one or more vibration detectors per se may be employed wherein the signals generated thereby are computer or microprocessor analyzed as described and in accordance with the the programming of the memory or analyzing circuits of such computer, automatic determination is made if the vibrations detected constitute an attempted theft or if the signals generated by the single accelerometer constitute such an attempt.

It is noted that the signals generated by three accelerometers as provided, for example, in the system shown in FIG. 2, when digitized, may be employed to indicate the location of the moved or moving object at any instant and that such location may be remotely indicated by corresponding signals generated by the computer or microprocessor 24 or by transmitting the outputs of the analog-to-digital converters 19–22 directly via transmitter 28 to the receiver 44 and analyzing same by a properly constructed computer such as 46 which is operable to control display 52 to display characters or other indications of the location of the object at the times the display is activated.

It should be understood with respect to the drawings that power supplies such as batteries, sources of line current or the like having the correct polarities and magnitudes are provided where not indicated in the drawings, so as to supply proper electrical energy for appropriately operating the various illustrated circuits as described in the specification.

In a preferred form of the instant invention, the battery employed to provide electrical energy for operating the motion and vibration sensors, computer or microprocessor, code generator, short wave transmitter and local alarm of FIG. 2 may be normally disconnected from such circuits by an inertia switch which is normally open when at rest but which momentarily closes when in motion. Such switch combined with a latch activated when the switch closes as the object to which it is secured is moved may comprise a multi-axis mercury switch or a universally pivoted arm contactor within a ring contactor or other suitable switch. The latch so employed may be controlled to maintain circuit closure with the battery until an unlatching signal is received thereby from the computer or electronic microprocessor 24 which is programmed to detect when the object being protected from theft has been moved in normal handling, during cleaning or maintenance or as a result of an inadvertent jarring. As a result of such a normally open circuit arrangement, a single battery may be employed to protect an object or machine from theft for a long period of time. If the battery should approach a state of discharge, an electronic detector of such condition may be employed for activating a local alarm or code generator for generating and short wave transmitting a code indicating such battery condition to the receiver 44 of FIG. 3 wherein computer 46 analyzes such code and controls display 52 or an auxilliary alarm to indicate such condition and the location of the object and battery approaching discharge condition. System 10 and the vibration sensor-computer combination may also be employed to indicate a machine malfunction or unauthorized operation.

The battery control arrangement described above is illustrated in FIG. 2 wherein a battery 32 which is employed to provide electrical energy for energizing all of the electrical components illustrated, has its output 33 connected to the input of a normally open inertially closed switch 34 of the type described which, when momentarily closed provides current from the battery to the setting input S of a latch 35 when then gates current from the battery to the computer 24 and the other electrically energized components and circuits of the system 10 permitting the system to function as described. If the computer 24 determines thereafter by signal analysis as described if the acceleration(s) imparted to the object which caused the normally open switch 34 to close are not indicative that the object is being moved in an unauthorized manner or act of theft thereof, a feedback signal is generated on an output of the computer and applied to the reset input R of the latch to open the latch and cause electrical energy from the battery which is passing through the latch to be disconnected from the output of the latch switch thereby terminating use of the battery until the inertially closed switch 34 is next closed.

I claim:

1. A theft detection system comprising in combination with a movable object to be protected against theft, said system including;

first means for detecting the motion of said object when said object is moved away from an at-rest location, said first means including means for generating analog electrical signals which are indicative of the motion of said objects from and beyond said at-rest location, second means for receiving said analog signals and digitizing same to generate digital signals representative of said analog signals, third means including electronic computing means for receiving the digital signals generated by said second means and generating control signals, fourth means for receiving said control signals and operative to generate code signals, fifth means for short wave transmitting said code signals, sixth means including short wave receiving means for receiving said short wave transmitted code signals, and seventh means including an alarm means connected to said short wave receiving means for receiving and using the code signals received thereby and generating an indication of an attempt to move said object from said at-rest location.

2. A theft detection system in accordance with claim 1 wherein said first means comprises an accelerometer operable to generate an analog signal indicative of the acceleration of said object when it is moved from said at-rest location.

3. A theft detection system in accordance with claim 1 wherein said first means includes at least three accelerometers, each operable to generate respective signals indicative of the acceleration of said object along a different of three axes when it is moved from said at-rest location.

4. A theft detection system in accordance with claim 1 wherein said electronic computing means is operable to detect when said object is moved a select distance from said at-rest location so that said alarm means will not be activated during minor movements of said object necessitated, for example, during cleaning or displaying said object.

5. A system in accordance with claim 1 wherein said alarm means includes a display operable when said code is received by said short wave receiving means to display the location of said object.

6. A system in accordance with claim 1 including speech signal generating means operable upon receipt of said code signals for generating speech signals of words indicative of the location of an object being moved from its at rest location.

7. A system in accordance with claim 1 including vibration sensing means for sensing vibrations imparted to said object during its movement and computing means for analyzing the output of said sensing means and determining if an attempt is being made to move said object from its at-rest location.

8. A system in accordance with claim 3 including a vibration sensor for generating signals when vibrations are imparted to said object, digitizing means for generating digital signals indicative of the vibration sensor operation, said computing means being operable to receive said latter digital signals and analyze same together with the signals generated by said accelerometers to determine if an attempt is being made to illegally remove said object from its at-rest location.

9. A system in accordance with claim 1 including a battery for electrically energizing said first, second, third, fourth and short wave transmitting means, and a normally open switch means for preventing energizing current from said battery from being used, said normally open switch being inertially operable to close and connect said battery with said first, second, third, fourth and short wave transmitting means when the object to which said latter means are attached is moved and latch means for maintaining said normally open switch closed for a sufficient time interval to permit said control signals to be generated by said third means and short wave transmitted to said short wave receiving means to indicate thereat that the object protected is in motion.

10. A system in accordance with claim 9 wherein said third means is connected to the resetting input to said latch means and is operable to cause said latch means to unlatch and disconnect said battery from activating said first, second, third, fourth and short wave transmitting means when its circuits determine that the objects to which said circuits are attached is not being moved in an unauthorized manner, wherein when such determination is made by said electronic computing means of said third means, said control and code signals are not generated and short wave transmitted to said receiving means.

11. A theft detection system comprising in combination with a movable object to be protected against theft and including:

first means for detecting vibrations imparted to said movable object during its movement from an at-rest location, said first means including means for generating electrical signals which are indicative of the vibrations detected and digitizing means for receiving said electrical signals and generating digital signals indicative of said vibrations, second means for including electronic computing means for receiving the digital signals generated by said digitizing means and generating control signals, third means for receiving said control signals and generating code signals, fourth means for short wave transmitting said code signals, fifth means for including short wave receiving means for receiving the short wave code signals transmitted by said fourth means, and alarm means connected to said short wave receiving means for receiving and using the code signals received by said fifth means and generating an indication of an attempt to move said object from said at-rest location.

12. A theft detection system in accordance with claim 1 wherein said first means is secured to said movable object.

13. A theft detection system comprising in combination with a movable object to be protected against theft including:

first means for detecting the movement of said object from an at-rest location and generating control signals, second means for receiving said control signals and generating code signals, means for short wave transmitting said code signals, short wave receiving means for receiving said short wave transmitted code signals, alarm means connected to said short wave receiving means for receiving and using the code signals received thereby and generating an indication of an attempt to move said object from said at-rest location, battery means for energizing said first and second means, a normally open switch means connected between said battery means and said first and second means for preventing energizing current from said battery means from being used, said normally open switch means being inertially operable to close and connect said battery means with said first and second means and said short wave transmitting means when the motion of said object is detected by said first means, and latch means for maintaining said normally open switch means closed for a sufficient time interval after it is closed to permit said control signals to be generated by said second means and to be short wave transmitted to said third means.

* * * * *